US008790223B2

(12) United States Patent
Wang

(10) Patent No.: US 8,790,223 B2
(45) Date of Patent: Jul. 29, 2014

(54) ADJUSTABLE DUMBBELL

(75) Inventor: Lo Pin Wang, Taichung (TW)

(73) Assignee: Beto Engineering & Marketing Co., Ltd., Beitun Taichung (TW)

( * ) Notice: Subject to any disclaimer, the term of this patent is extended or adjusted under 35 U.S.C. 154(b) by 224 days.

(21) Appl. No.: 13/535,478

(22) Filed: Jun. 28, 2012

(65) Prior Publication Data

US 2014/0005012 A1 Jan. 2, 2014

(51) Int. Cl.
*A63B 21/00* (2006.01)

(52) U.S. Cl.
USPC ..... 482/106; 482/108; 482/110

(58) Field of Classification Search
USPC ..... 482/106, 108, 110
See application file for complete search history.

(56) References Cited

U.S. PATENT DOCUMENTS 5,407,413 A * 4/1995 Kupferman ..... 482/106
5,839,997 A 11/1998 Roth et al.
6,416,446 B1 7/2002 Krull
6,656,093 B2 * 12/2003 Chen ..... 482/108
6,669,606 B2 12/2003 Krull
6,719,674 B2 4/2004 Krull
6,733,424 B2 5/2004 Krull
7,137,931 B2 11/2006 Liu
7,153,243 B1 12/2006 Krull
7,172,536 B2 2/2007 Liu
7,223,214 B2 5/2007 Chen
7,485,077 B2 2/2009 Chen
7,731,641 B1 6/2010 Chen
8,025,613 B1 9/2011 Wang
8,123,662 B2 * 2/2012 Anderson ..... 482/107

* cited by examiner

*Primary Examiner* — Jerome W Donnelly
(74) *Attorney, Agent, or Firm* — Charles E. Baxley

(57) ABSTRACT

An adjustable barbell or dumbbell or exercise device includes a handle having two end members, two carriers attached to the end members of the handle respectively, and a weight member having one or more latch members for detachably attaching to the end member of the handle, and a lock member slidably attached to the weight member and having a tongue for engaging with the carrier and for locking the weight member to the handle when the latch members of the weight member are rotated relative to the carrier, the other weight members are attachable to the weight member with the other latch members and the other lock member without supporting the weight members in a supporting base.

19 Claims, 13 Drawing Sheets

ADJUSTABLE DUMBBELL

BACKGROUND OF THE INVENTION

1. Field of the Invention

The present invention relates to an adjustable exercise device or dumbbell or the like, and more particularly to an adjustable exercise device or dumbbell including an improved structure for allowing the weight members to be easily and quickly and readily and adjustably attached to or disengaged from the weight carrier or handle and for allowing the adjustable dumbbell to be easily operated by the user.

2. Description of the Prior Art

Typical exercise devices or barbells or dumbbells comprise a handle to be grasped or held by the user, and a number of weight plates to be attached onto the ends of the handle for weight lifting or exercising purposes, or for exercising or training the upper muscle groups or the lower muscle groups of the user.

For example, U.S. Pat. No. 5,839,997 to Roth et al., U.S. Pat. No. 6,416,446 to Krull, U.S. Pat. No. 6,656,093 to Chen, U.S. Pat. No. 6,669,606 to Krull, U.S. Pat. No. 6,719,674 to Krull, U.S. Pat. No. 6,733,424 to Krull, U.S. Pat. No. 7,137,931 to Liu, U.S. Pat. No. 7,153,243 to Krull, U.S. Pat. No. 7,172,536 to Liu, U.S. Pat. No. 7,223,214 to Chen, U.S. Pat. No. 7,485,077 to Chen, and U.S. Pat. No. 8,025,613 to Wang disclose several typical adjustable dumbbells each comprising a number of weight plates or weight members selectively or adjustably attaching or mounting onto the handle shaft or handle bar that is provided for being held or grasped by the users to train the upper muscle groups or the lower muscle groups of the user, and a latch device attached onto the handle and/or the weighted plates for selectively or adjustably mounting or securing selected or different number of the weighted plates on the ends of the handle and for exercising or training the upper muscle groups or the lower muscle groups of the user.

However, a supporting base is further required to be provided for stably supporting the weight plates or weight members in place, and the latch device is required to be moved relative to the handle or the weight plates or weight members or actuated to engage with the required or selected number of the weighted plates or weight members when the weight plates or weight members are supported on or in the supporting base, and before the handle and the weight plates or weight members may be lifted or moved away from the supporting base; i.e., the weight plates or weight members should be solidly and stably disposed and received and supported in the supporting base, and the latch device is required to be moved relative to the handle or the weight plates or weight members or actuated to engage with and to couple the required or selected number of the weighted plates or weight members to the handle before the handle and the weight plates or weight members may be lifted or moved away from the supporting base.

U.S. Pat. No. 7,731,641 to Chen discloses a further typical adjustable dumbbell comprising a series of weighted plates to be attached onto the ends of the handle, and a lock nut should be attached onto the ends of the handle for selectively or adjustably mounting or securing or anchoring the weighted plates on the ends of the handle.

However, it takes a long time to thread and unthread the lock nuts from the handle in order to attach or mount the required or selected number of the weight plates or weight members onto or from the ends of the handle.

The present invention has arisen to mitigate and/or obviate the afore-described disadvantages of the conventional adjustable dumbbells.

SUMMARY OF THE INVENTION

The primary objective of the present invention is to provide an adjustable exercise device or dumbbell including an improved structure for allowing the weight members to be easily and quickly and readily and adjustably attached to or disengaged from the weight carrier or handle and for allowing the adjustable dumbbell to be easily operated by the users.

The other objective of the present invention is to provide an adjustable exercise device or dumbbell including an improved structure for allowing the weight members to be easily and quickly and readily and adjustably attached to or disengaged from the weight carrier or handle without supporting the weight members in a supporting base.

In accordance with one aspect of the invention, there is provided an adjustable exercise device comprising a handle including a first end member and a second end member, a first carrier attached to the first end member of the handle, and including a first latch groove formed therein and located around a center portion of the first carrier, and including a cavity formed therein, the first latch groove of the first carrier including a first end portion and a second end portion, a first weight member including a first latch member extended therefrom for engaging with the first latch groove of the first carrier and for detachably attaching the first weight member to the first end member of the handle with the first carrier, the first weight member being rotatable relative to the first carrier and the first end member of the handle for causing the first latch member to move from the first end portion to the second end portion of the first latch groove of the first carrier and for detachably and selectively latching the first weight member to the first end member of the handle with the first carrier, and a lock member slidably attached to the first weight member and including a tongue extendible out of the first weight member for selectively engaging with the cavity of the first carrier and for selectively locking the first weight member to the first end member of the handle when the first latch member of the first weight member is moved to and engaged with the second end portion of the first latch groove of the first carrier, and thus for allowing the weight member to be easily and quickly and readily attached or mounted or secured to or removed or disengaged from the handle without supporting the weight members in a supporting base.

The first weight member includes a spring biasing member engaged with the lock member for biasing and forcing the tongue of the lock member to engage with the cavity of the first carrier. The first weight member includes a knob attached to the lock member for actuating and moving the lock member relative to the first weight member.

The first weight member includes a compartment formed therein for slidably receiving the lock member, and includes a channel formed therein and communicative with the compartment of the first weight member for slidably receiving the knob of the lock member.

The first end portion of the first latch groove of the first carrier is a relatively wider end portion, and the second end portion of the first latch groove of the first carrier is a relatively narrower end portion. The first carrier includes a catch extended into the second end portion of the first latch groove of the first carrier for forming the relatively narrower end portion of the first latch groove of the first carrier.

The handle includes a recess formed in the first end member of the handle and defined by an outer peripheral fence for receiving and engaging with the first carrier. The first latch member of the first weight member includes a stem extended outwardly from the first weight member, and an enlarged head provided on the stem and having an outer diameter greater than that of the stem.

The first weight member includes a carrying member attached thereto, and the carrying member includes a latch groove formed therein and located around a center portion of the carrying member, and the latch groove of the carrying member includes a first end portion and a second end portion. The carrying member includes an aperture formed therein.

The first weight member includes a non-circular depression formed therein, and the carrying member includes a non-circular cross section for engaging with the non-circular depression of the first weight member and for preventing the carrying member from being rotated relative to the first weight member. The first weight member includes two apertures formed therein and located around the center portion of the carrying member for selectively engaging with the locking member.

The carrying member includes a catch extended into the second end portion of the latch groove of the carrying member for forming a relatively narrower second end portion of the latch groove of the carrying member, and a relatively wider first end portion of the latch groove of the carrying member.

The first carrier includes at least one second latch groove formed therein and located around the center portion of the first carrier, and having a relatively wider first end portion and a relatively narrower second end portion. The first weight member includes at least one second latch member extended therefrom for engaging with the at least one second latch groove of the first carrier.

A second carrier is further provided and attached to the second end member of the handle, and including a second latch groove formed therein and located around a center portion of the second carrier, and including a cavity formed therein, the second latch groove of the second carrier including a first end portion and a second end portion, a second weight member including a second latch member extended therefrom for engaging with the second latch groove of the second carrier and for detachably attaching the second weight member to the second end member of the handle with the second carrier, the second weight member being rotatable relative to the second carrier and the second end member of the handle for causing the second latch member to move from the first end portion to the second end portion of the second latch groove of the second carrier and for detachably latching the second weight member to the second end member of the handle with the second carrier, and a lock member slidably attached to the second weight member and including a tongue extendible out of the second weight member for selectively engaging with the cavity of the second carrier and for locking the second weight member to the second end member of the handle when the second latch member of the second weight member is moved to engage with the second end portion of the second latch groove of the second carrier and when the second weight member is rotated relative to the first weight member.

The second carrier includes a catch extended into the second end portion of the second latch groove of the second carrier for forming a relatively narrower second end portion and a relatively wider first end portion for the second latch groove of the second carrier.

The second latch member of the second weight member includes a stem extended outwardly from the second weight member, and an enlarged head provided on the stem and having an outer diameter greater than that of the stem.

The second weight member includes a carrying member attached thereto, and the carrying member includes a latch groove formed therein and located around a center portion of the carrying member, and the latch groove of the carrying member includes a first end portion and a second end portion.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
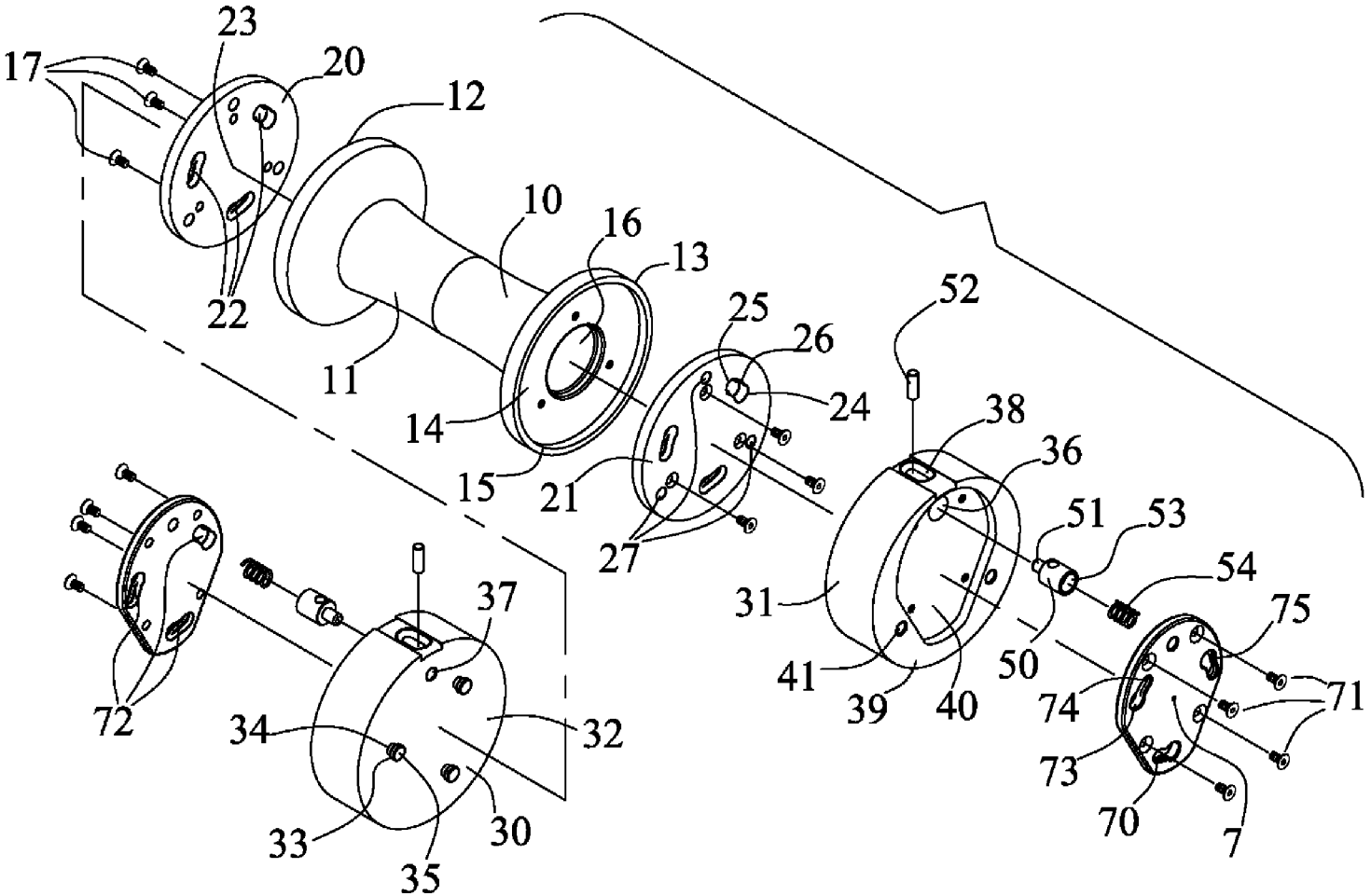
FIG. 1 is a partial exploded view of an adjustable exercise device or barbell or dumbbell in accordance with the present invention.
Figure 2:
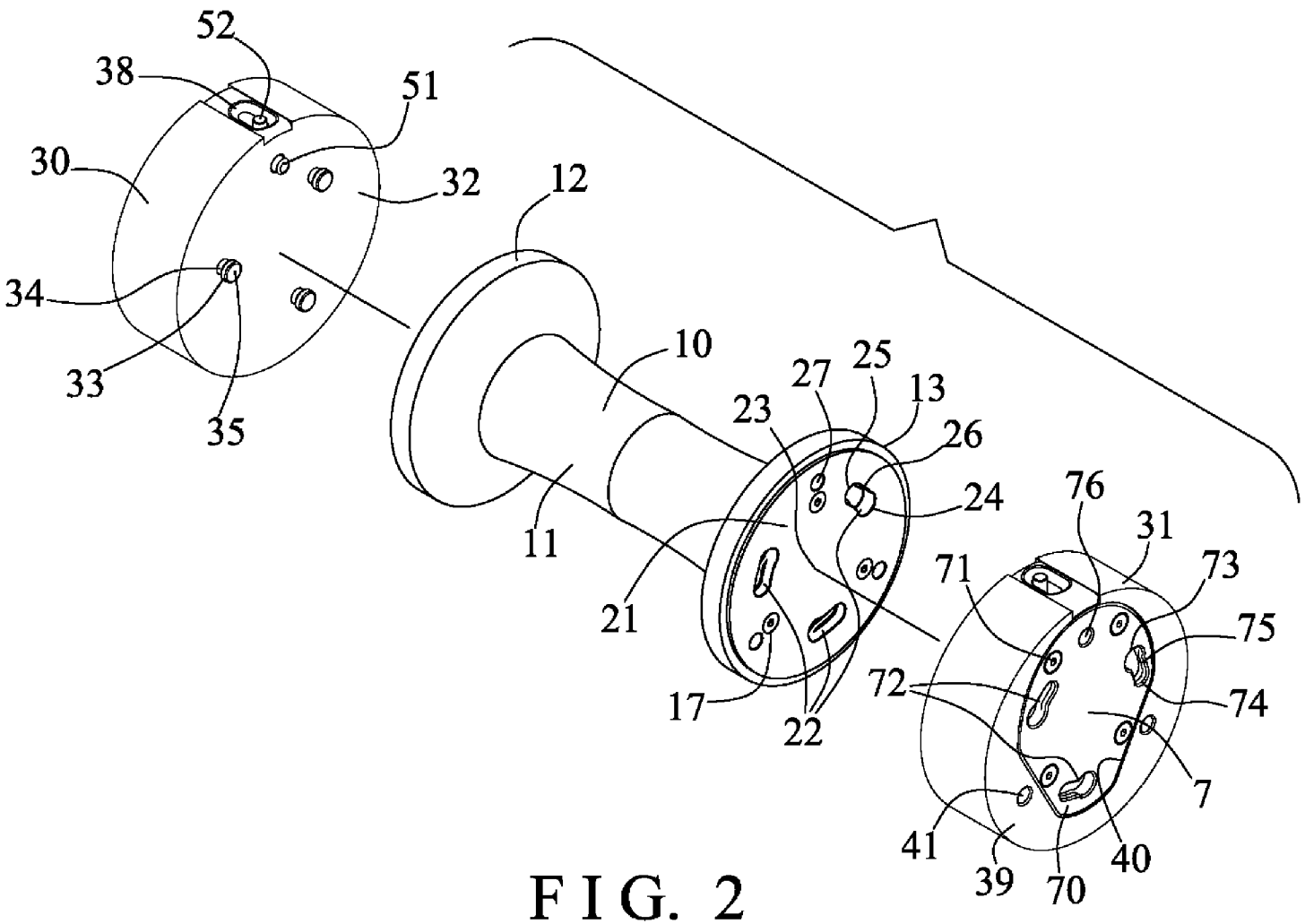
FIG. 2 is another partial exploded view of the adjustable dumbbell.
Figure 3:
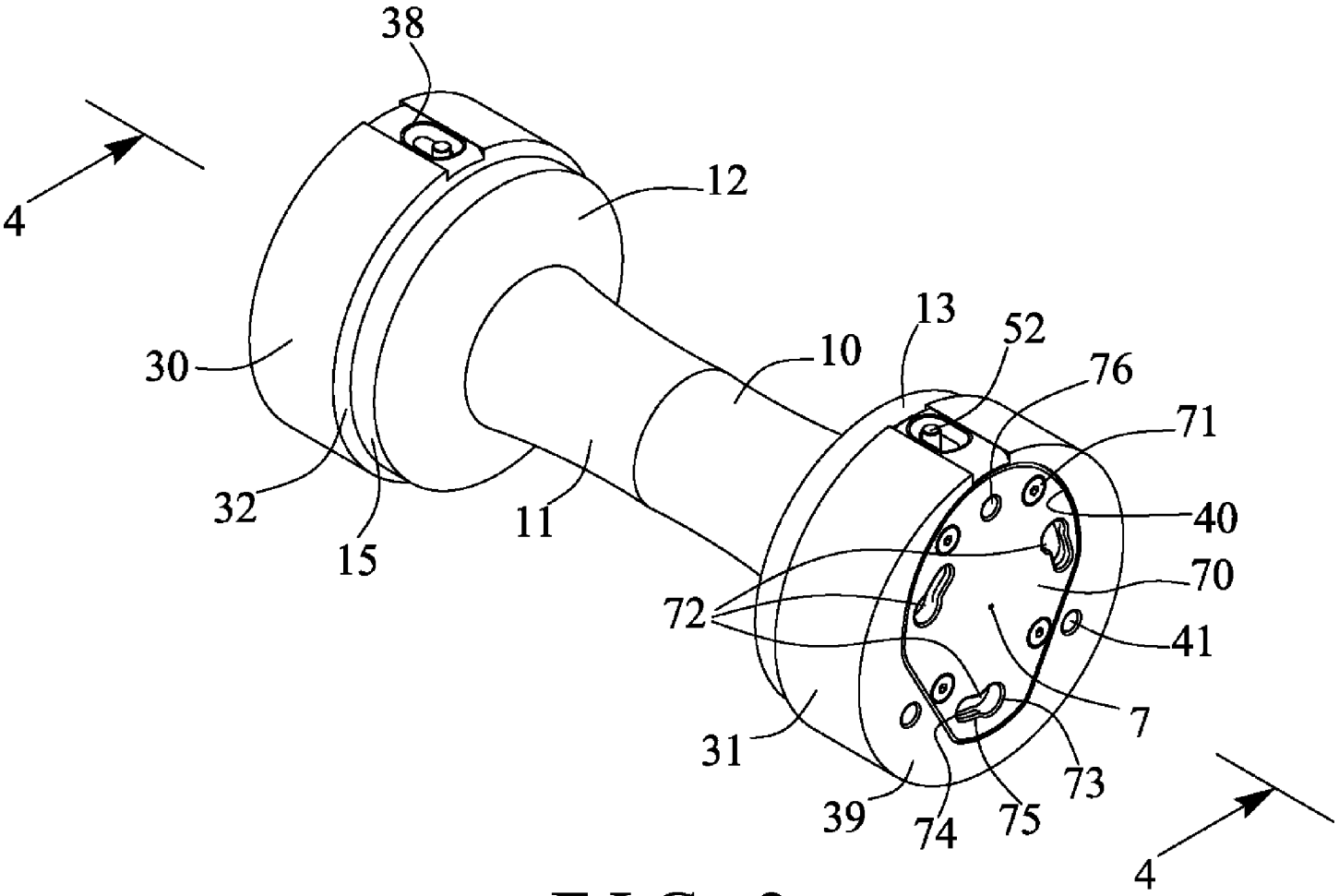
FIG. 3 is a perspective view of the adjustable dumbbell.
Figure 4:
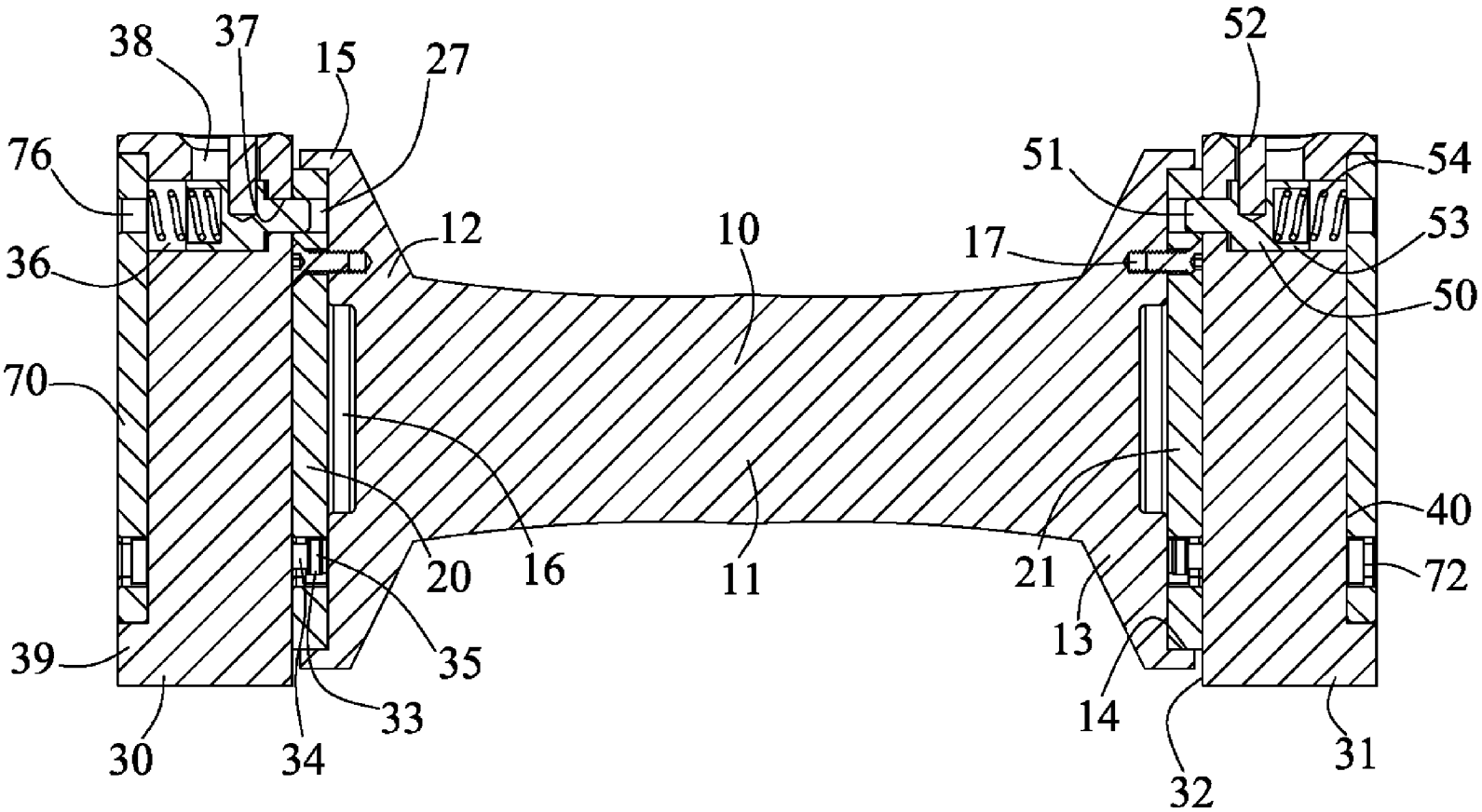
FIG. 4 is a cross sectional view of the adjustable dumbbell, taken along lines 4-4 of FIG. 3.
Figure 5:
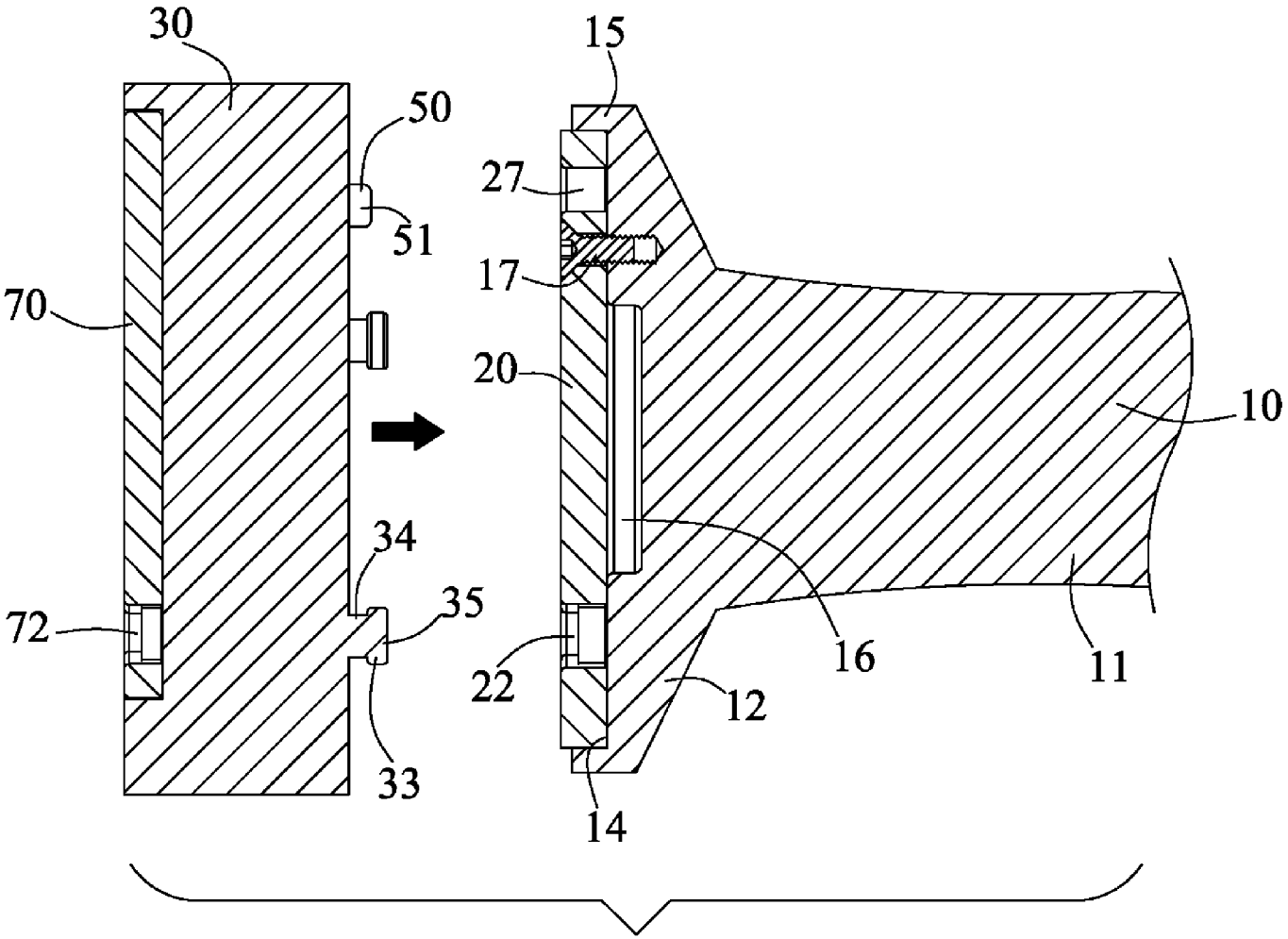
FIG. 5 is a partial exploded and cross sectional view of the adjustable dumbbell.
Figure 7:
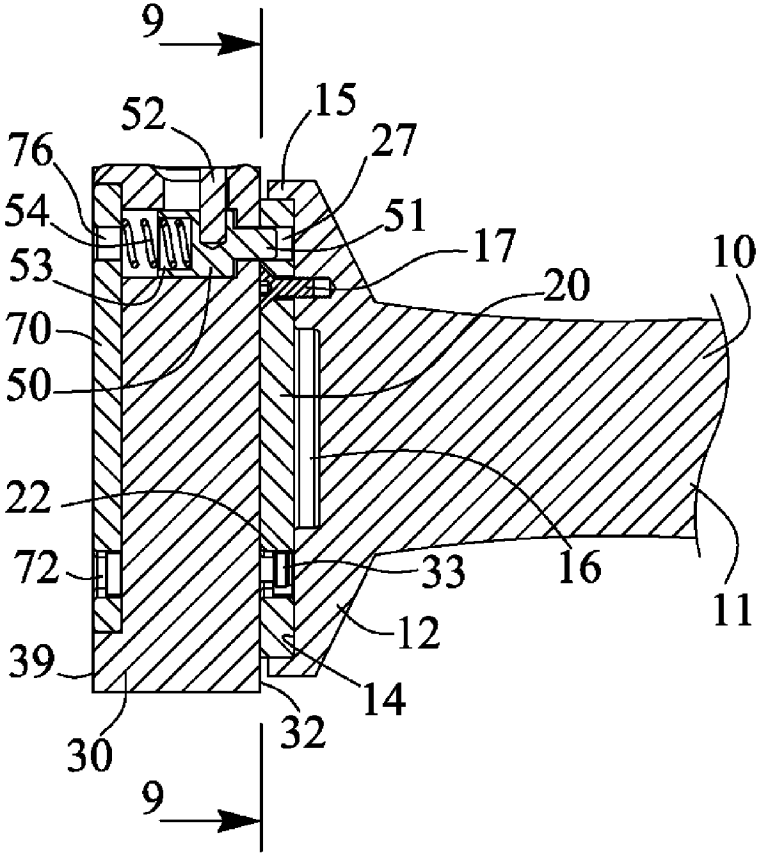
FIGS. 6, 7 are partial cross sectional views illustrating the operation of the adjustable dumbbell.
Figure 6:
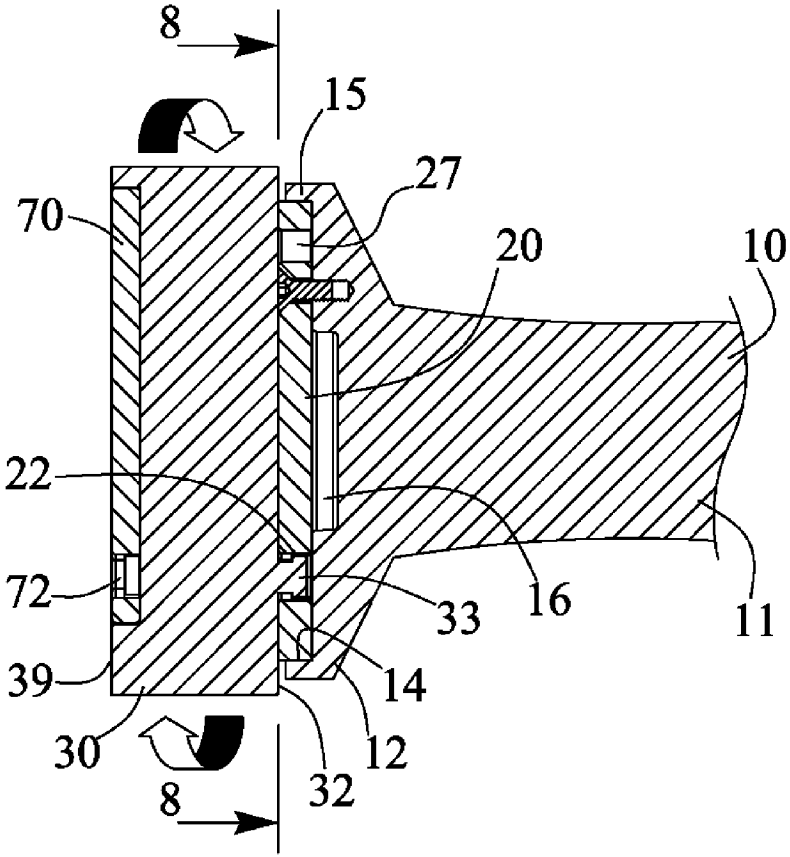
Figure 9:
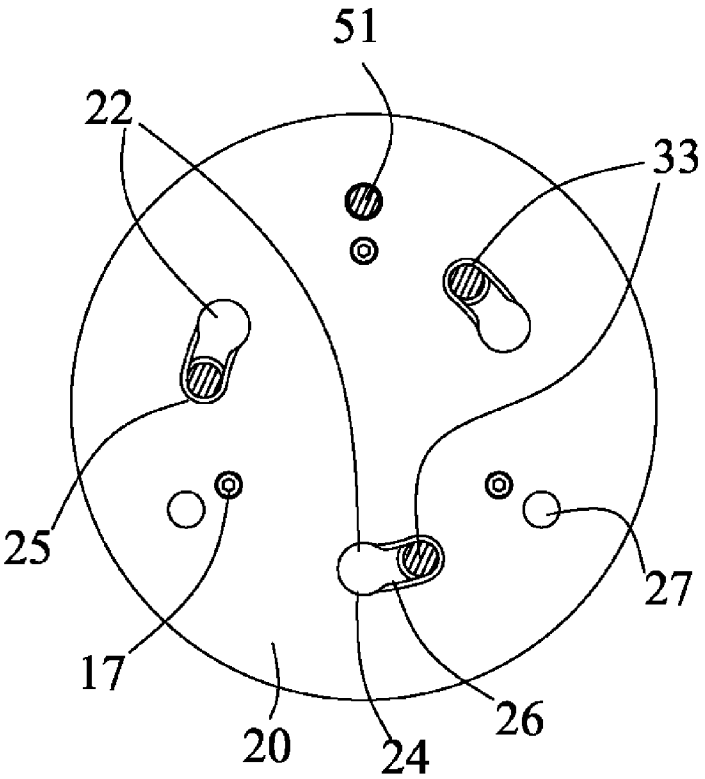
FIGS. 8, 9 are cross sectional views taken along lines 8-8, and 9-9 of FIGS. 6 and 7 respectively.
Figure 8:
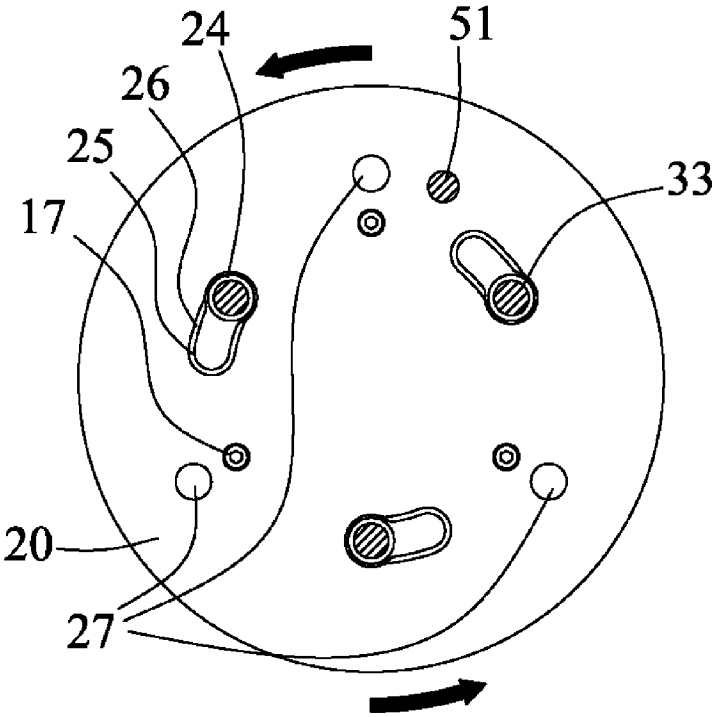
Figure 10:
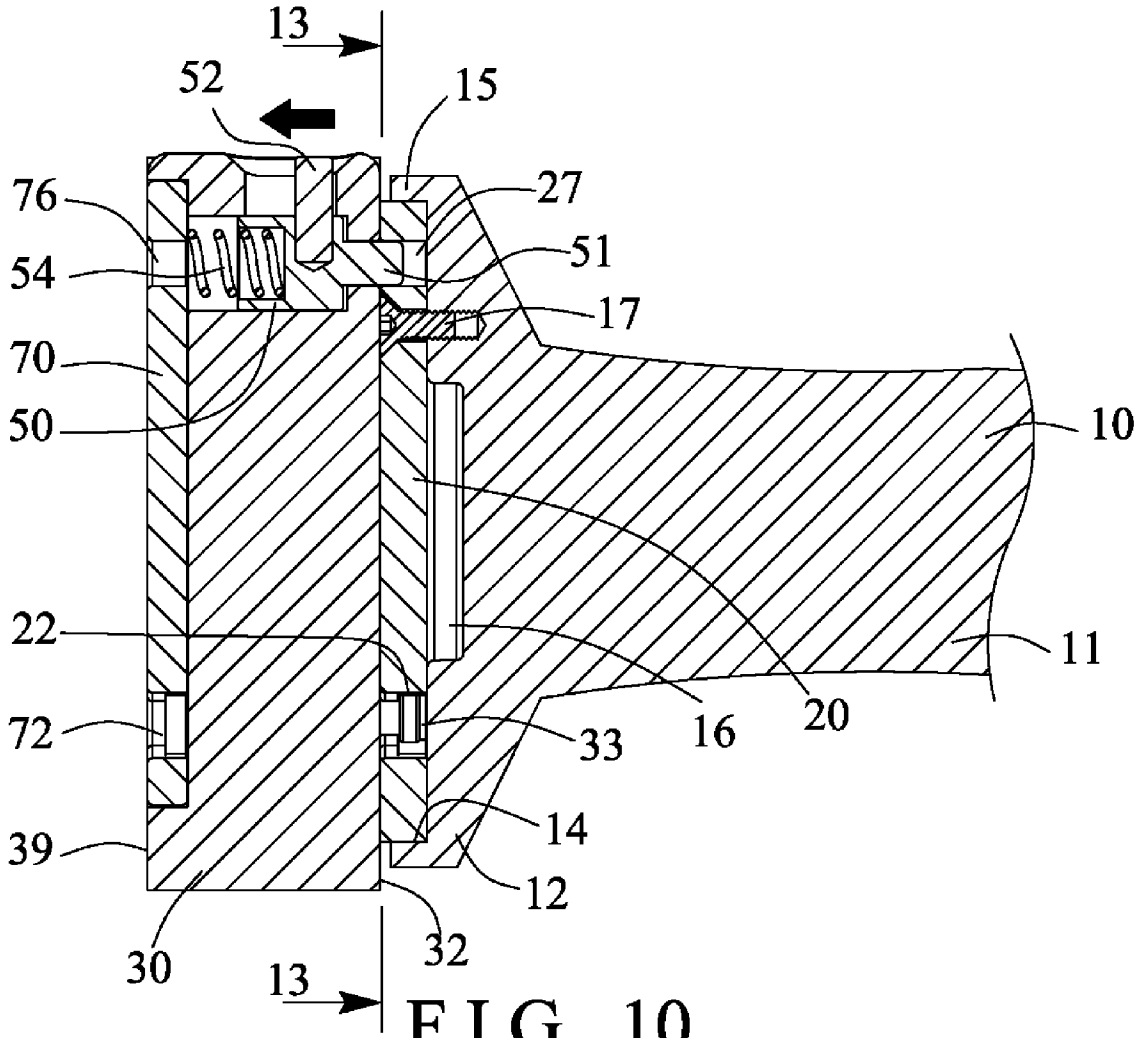
FIGS. 10, 11, 12 are partial cross sectional views similar to FIGS. 6-7 illustrating the operation of the adjustable dumbbell.
Figure 12:
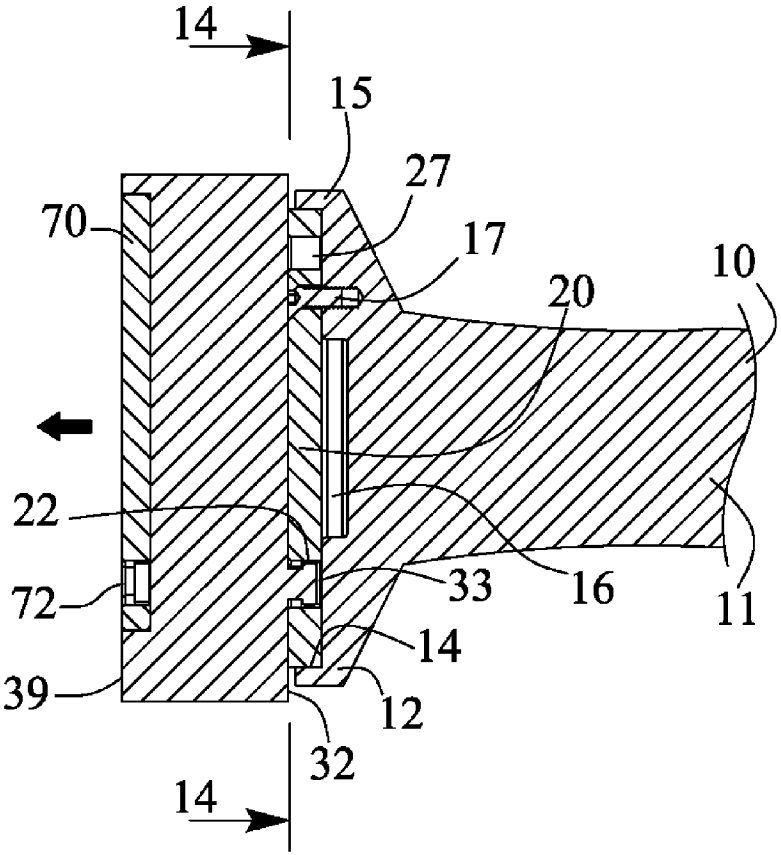
Figure 11:
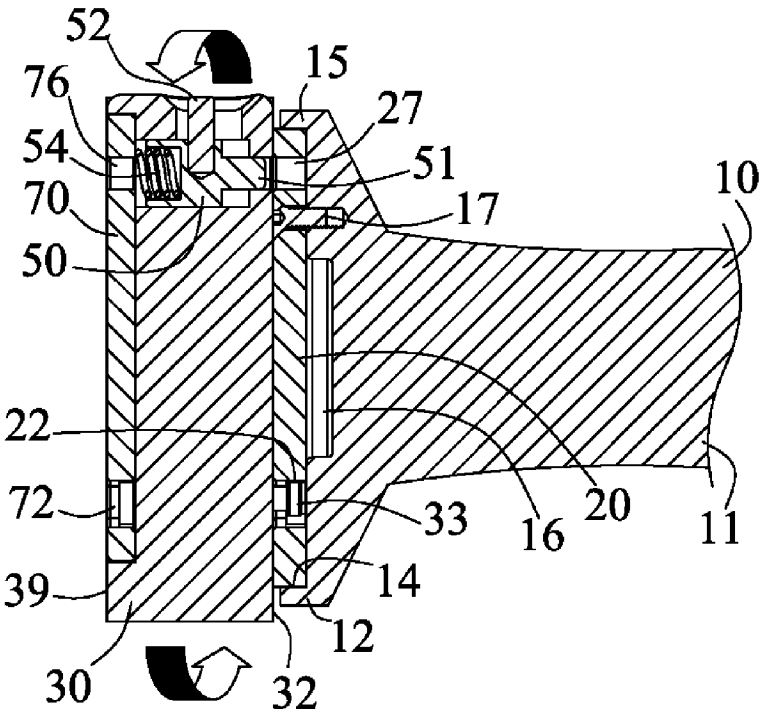
Figure 14:
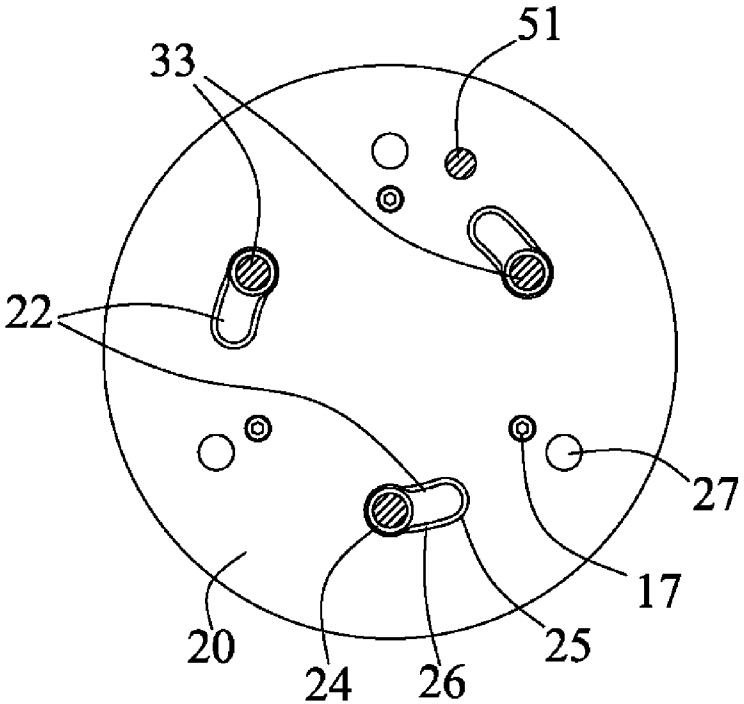
FIGS. 13, 14 are cross sectional views taken along lines 13-13, and 14-14 of FIGS. 10 and 12 respectively.
Figure 13:
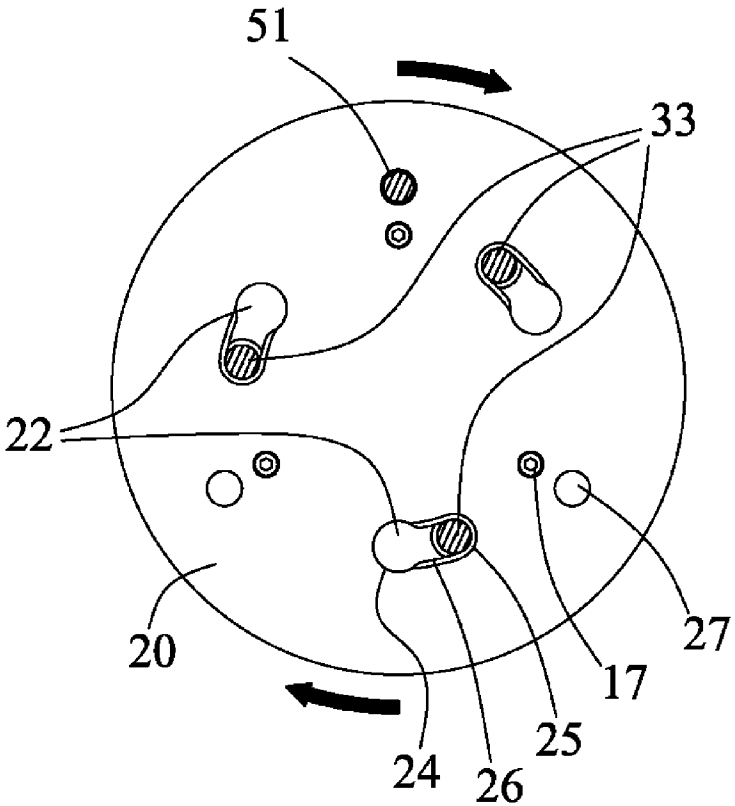

Referring to the drawings, and initially to FIGS. 1-4, an adjustable dumbbell or barbell or exercise device in accordance with the present invention comprises a longitudinal shaft or handle 10 including a hand grip 11 formed or provided on the middle or center portion thereof for being grasped or held by the user and for carrying or lifting or moving the handle 10 and for allowing the adjustable dumbbell to be easily operated by the user, and including two end plates or end portions or end members 12, 13, such as first and second end members 12, 13 each having a depression or compartment or recess 14 formed therein and opened outwardly and formed or defined by an outer peripheral rib or flange or fence 15, and including a depression or recess or cavity or space 16 formed or provided in the middle or center portion of each of the end portions or end members 12, 13 thereof and communicative with the respective recess 14 of the handle 10. The end members 12, 13 each include an outer diameter greater than that of the hand grip 11.

Two end members or carriers 20, 21, such as a first carrier 20 and a second carrier 21, are disposed or engaged into the recess 14 of the end members 12, 13 or of the handle 10 respectively, and attached or mounted or secured to the end members 12, 13 of the handle 10 with one or more welding portions, adhesive members, lock pin members, or latches or fasteners 17, and each include one or more (such as three), or first and second and third latch grooves 22 formed therein and disposed or located or arranged around a center portion 23 thereof, and the latch grooves 22 of the carrier 20, 21 each include two end portions 24, 25, and the carrier 20, 21 includes one or more (such as two) opposite projections or catches 26 extended into the respective latch groove 22 and disposed or arranged or located close to one of the end portions 24, 25 of the respective latch groove 22 for forming or defining a relatively wider end portion 24 and a relatively narrower end portion 25 for the respective latch groove 22 of the carrier 20, 21.

Figure 16:
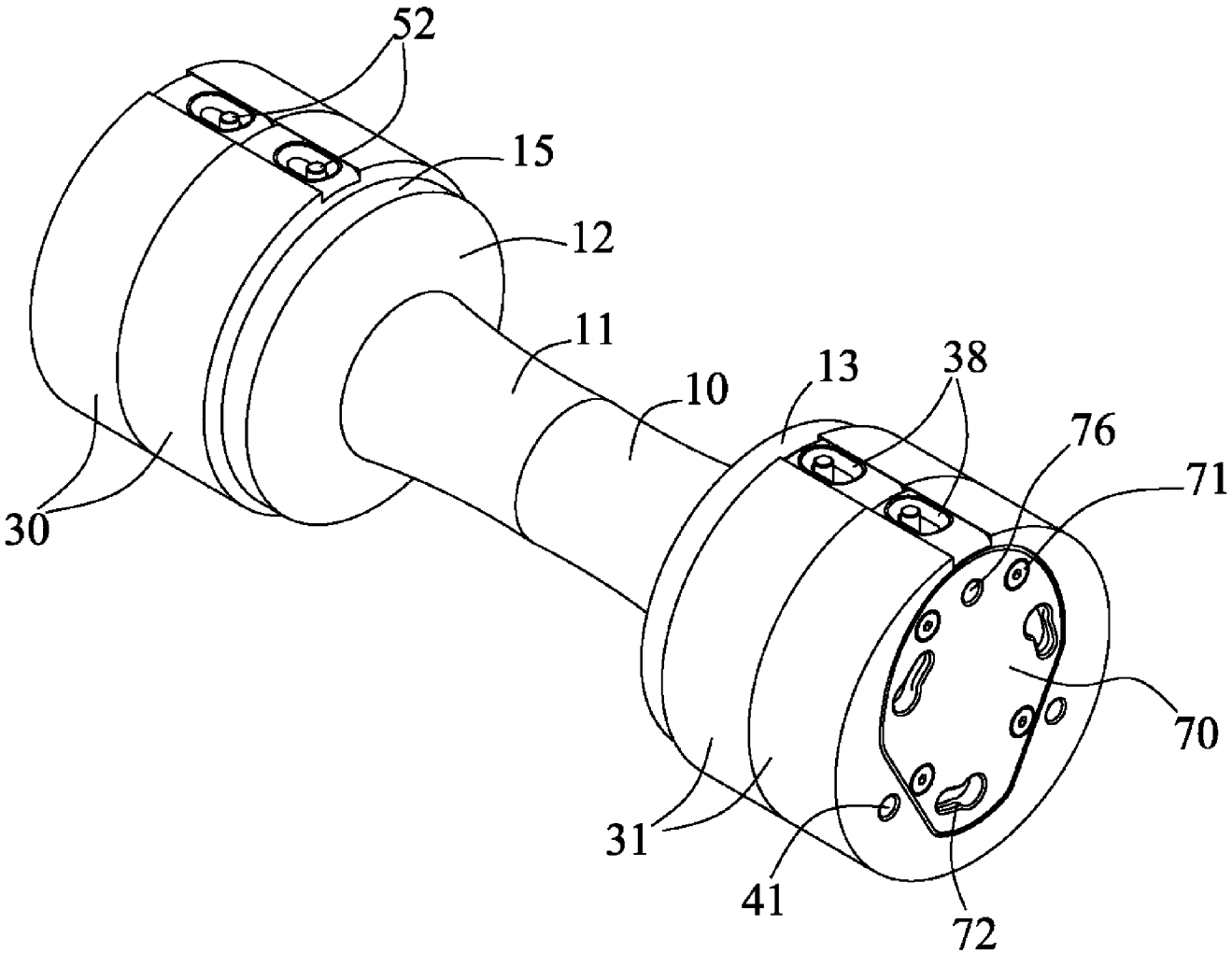
FIGS. 16, 17 are perspective views illustrating the operation of the adjustable dumbbell.
Figure 17:
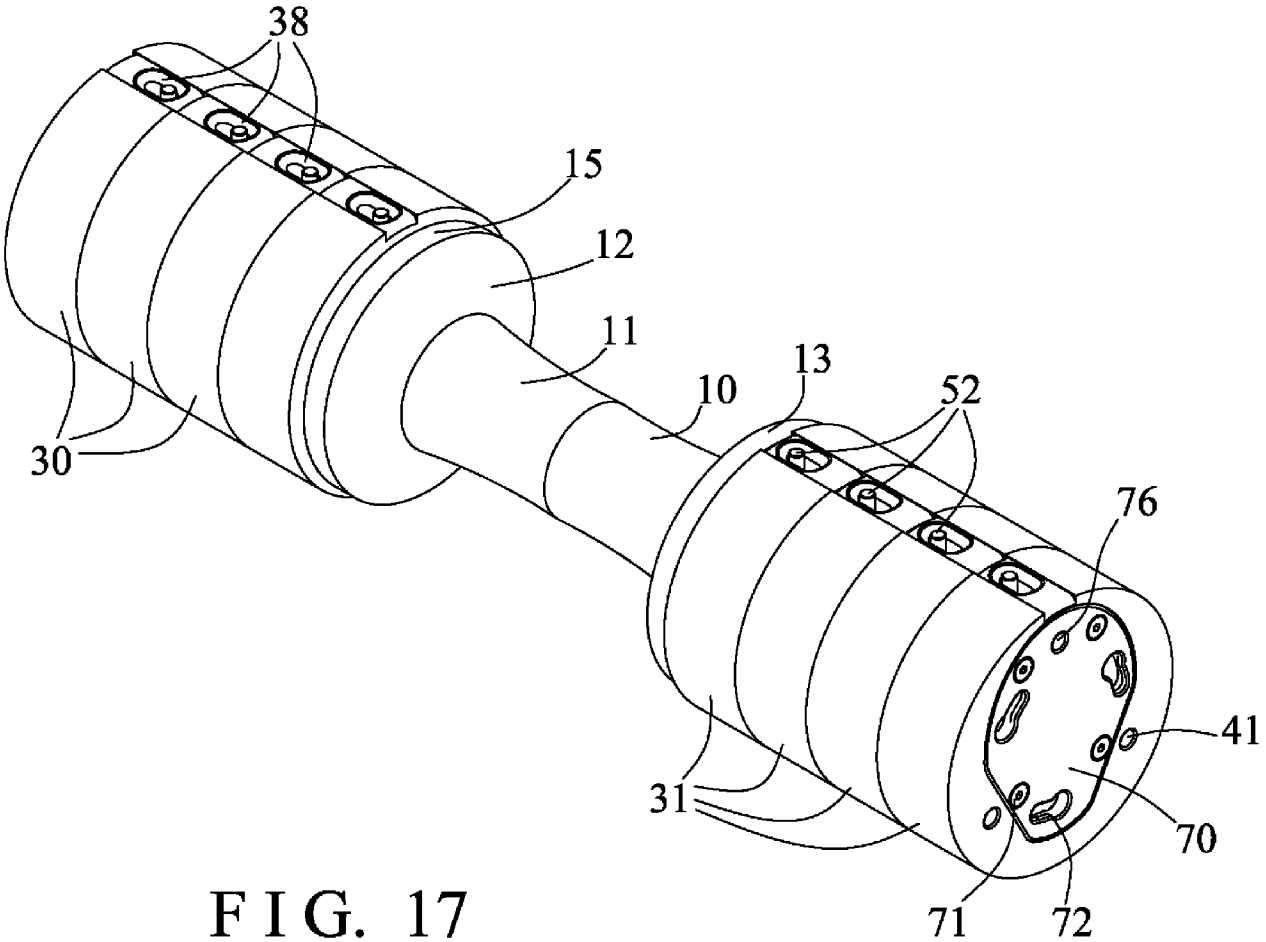

The carriers 20, 21 each further includes one or more (such as three) cavities 27 formed therein and disposed or located or arranged around the center portion 23 thereof, and disposed or arranged or located close to the latch grooves 22 respectively, the cavities 27 of the carrier 20, 21 may be disposed or located at the radius or distance identical or similar to that of the latch grooves 22 away from the center portion 23 of the carrier 20, 21, or may be disposed or located at the radius or distance greater than or smaller than that of the latch grooves 22 from the center portion 23 of the carrier 20, 21. It is preferable, but not necessarily that the latch grooves 22 are equally spaced from each other, and the cavities 27 of the carrier 20, 21 are also preferably equally spaced from each other. The carriers 20, 21 are provided for attaching or mounting or anchoring or retaining or securing or coupling one or more weight plates or weight members 30, 31, such as first and second and third and other weight members 30, 31 to the end members 12, 13 of the handle 10 (FIGS. 16-17).

The weight plates or weight members 30, 31 each include an inner or first surface 32 disposed or arranged or located or directed toward the end members 12, 13 or of the handle 10 respectively, and each include one or more (such as three) locks or latch members 33 extended outwardly therefrom for engaging with the latch grooves 22 of the carrier 20, 21 respectively and for detachably attaching or mounting or securing or coupling the weight members 30, 31 to the end members 12, 13 or of the handle 10 respectively, for example, the latch members 33 each include a stem 34 extended outwardly from the weight member 30, 31, and an enlarged head 35 formed or provided on the stem 34, in which the enlarged head 35 includes an outer diameter greater than that of the stem 34 for engaging into the relatively wider end portion 24 of the respective latch groove 22 of the carrier 20, 21, and is rotatable or movable or engageable into the relatively narrower end portion 25 of the respective latch groove 22 of the carrier 20, 21 and engageable with the catches 26 of the carrier 20, 21 for detachably attaching or mounting or securing or anchoring or retaining the weight members 30, 31 to the end members 12, 13 or of the handle 10 respectively.

The weight members 30, 31 each further include a cavity or compartment 36 formed therein (FIGS. 1, 4), and an orifice 37 formed therein and aligned with and/or communicative with the compartment 36 thereof, in which the orifice 37 is formed in the inner or first surface 32. A detent or lock member 50 is slidably received or engaged in the compartment 36 of the respective weight member 30, 31, and includes a tongue 51 slidably received or engaged in the orifice 37 of the weight member 30, 31 and extendible out through or out of the inner or first surface 32 of the weight member 30, 31 for selectively engaging with either of the cavities 27 of the carrier 20, 21 (FIG. 4) and for selectively attaching or mounting or securing or anchoring or retaining or locking the weight members 30, 31 to the end members 12, 13 or of the handle 10 respectively.

The weight members 30, 31 each further include a channel 38 formed therein and intersected or communicative with the compartment 36 of the respective weight member 30, 31, and the lock member 50 includes a hand grip or pin or knob 52 slidably received or engaged in the channel 38 of the weight member 30, 31 and attached or mounted or secured to the lock member 50 for moving the lock member 50 relative to the weight member 30, 31, and the lock member 50 further includes a hole 53 formed therein for receiving or engaging with a spring biasing member 54 which may bias and force the tongue 51 of the lock member 50 to selectively engage with either of the cavities 27 of the carrier 20, 21. The weight members 30, 31 each further include a recess or cavity or space or depression 40 formed in the outer or second surface 39 thereof and having a non-circular cross section and communicative with the compartment 36 thereof, and one or more (such as two) apertures 41 formed therein and separated or offset from the depression 40 thereof.

In operation, as shown in FIGS. 5-9, the latch members 33 of the weight member 30, 31 may first be disposed or arranged or directed toward the latch grooves 22 of the carrier 20, 21 respectively (FIG. 5), and may then be engaged into the relatively wider end portions 24 of the latch grooves 22 of the carrier 20, 21 respectively (FIGS. 6, 8), and may then be rotated or moved or pivoted relative to the carrier 20, 21 for engaging the latch members 33 of the weight member 30, 31 into the relatively narrower end portions 25 of the latch grooves 22 of the carrier 20, 21 and engageable with the catches 26 of the carrier 20, 21 respectively (FIGS. 7, 9) for detachably attaching or mounting or securing or anchoring or retaining the weight members 30, 31 to the end members 12, 13 or of the handle 10 with the carrier 20, 21. At this moment, the tongue 51 of the lock member 50 is forced to engage with either of the cavities 27 of the carrier 20, 21 for solidly and stably attaching or mounting or securing or anchoring or retaining or locking the weight members 30, 31 to the end members 12, 13 or of the handle 10 respectively.

Figure 15:
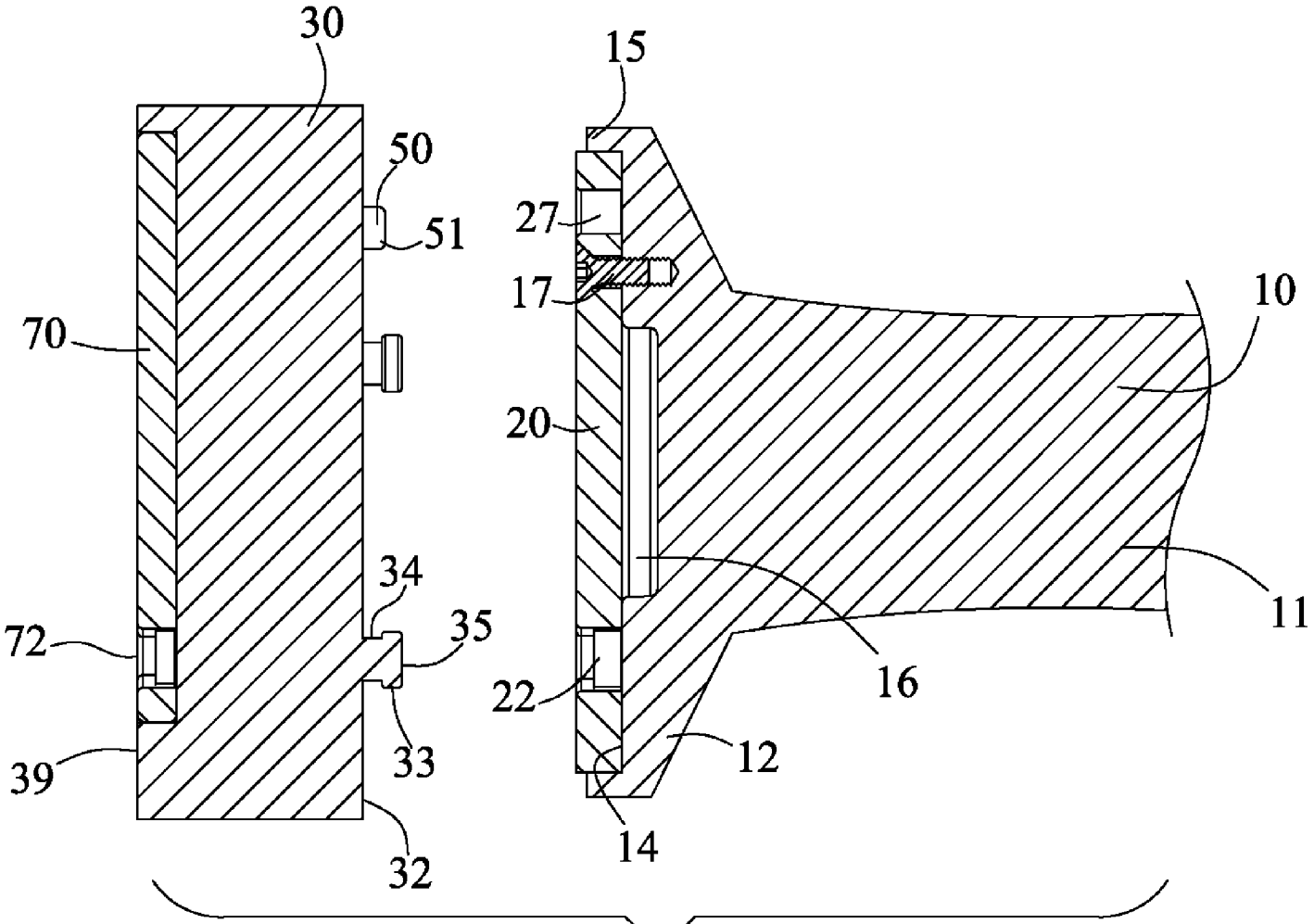
FIG. 15 is a further partial exploded and cross sectional view illustrating the operation of the adjustable dumbbell.

On the contrary, when it is required to remove or disengage the weight member 30, 31 from the end members 12, 13 of the handle 10, as shown in FIGS. 10-15, the tongue 51 of the lock member 50 may first be removed or disengaged from the cavity 27 of the carrier 20, 21 by sliding or moving the knob 52 along the channel 38 of the weight member 30, 31 (FIG. 10), at this moment, the weight member 30, 31 may then be rotated or moved or pivoted relative to the carrier 20, 21 (FIG. 11) to move and disengage the tongue 51 of the lock member 50 from the cavity 27 of the carrier 20, 21 and to move the latch members 33 of the weight member 30, 31 from the relatively narrower end portions 25 of the latch grooves 22 of the carrier 20, 21 (FIGS. 12, 13) to the relatively wider end portions 24 of the latch grooves 22 of the carrier 20, 21 respectively (FIG. 14), and thus for allowing the latch members 33 of the weight member 30, 31 to be removed or disengaged from the carrier 20, 21 (FIG. 15).

Referring again to FIGS. 1-4, another carrier or carrying member 70 is further provided and includes a corresponding non-circular cross section for engaging into or with the non-circular depression 40 of the respective weight member 30, 31 and for preventing the carrying member 70 from being pivoted or rotated relative to the weight member 30, 31, the carrying member 70 is attached or mounted or secured to the weight member 30, 31 with one or more welding portions, adhesive members, lock pin members, or latches or fasteners 71, and each also include one or more (such as three) latch grooves 72 formed therein and disposed or located or arranged around a center portion 7 thereof, and the latch grooves 72 of the carrying member 70 each include two end portions 73, 74, and the carrying member 70 includes one or more (such as two) opposite projections or catches 75 extended into the respective latch groove 72 and disposed or arranged or located close to one of the end portions 74 of the respective latch groove 72 for forming or defining a relatively wider end portion 73 and a relatively narrower end portion 74 for the respective latch groove 72 of the carrying member 70.

The carrying member 70 further includes an aperture 76 formed therein, and the aperture 76 of the carrying member 70 and the apertures 41 of the weight member 30, 31 are disposed or located or arranged around the center portion 7 of the carrying member 70, and disposed or arranged or located close to the latch grooves 72 respectively, and may be disposed or located at the radius or distance identical or similar to that of the latch grooves 72 away from the center portion 7 of the carrying member 70, or may be disposed or located at the radius or distance greater than or smaller than that of the latch grooves 72 from the center portion 7 of the carrying member 70. It is preferable, but not necessarily that the latch grooves 72 are equally spaced from each other, and the aperture 76 of the carrying member 70 and the apertures 41 of the weight member 30, 31 are also preferably equally spaced from each other. The carrying member 70 is provided for attaching or mounting or anchoring or retaining or securing or coupling one or more further weight members 30, 31 to the respective weight members 30, 31 (FIGS. 16-17).

In operation, the other or further weight members 30, 31 may have their latch members 33 engaged into the relatively wider end portions 73 of the latch grooves 72 of the carrying member 70 and then rotated or moved or pivoted relative to the carrying member 70 to engage the latch members 33 of the other or further weight member 30, 31 into the relatively narrower end portions 74 of the latch grooves 72 of the carrying member 70 and engageable with the catches 75 of the carrying member 70 respectively for easily and quickly and readily and detachably attaching or mounting or securing or anchoring or retaining the other or further weight members 30, 31 to the respective weight members 30, 31 with the carrying member 70 and the latch members 33 of the weight members 30, 31. The carrying member 70 may be engaged with the spring biasing member 54 for solidly and stably anchoring or retaining the spring biasing member 54 and the lock member 50 in the compartment 36 of the weight member 30, 31.

It is to be noted that the weight members 30, 31 may be easily and quickly and readily and detachably attached or mounted or secured or anchored or retained or engaged onto the end members 12, 13 of the handle 10 respectively with the carriers 20, 21 and the latch members 33 of the weight members 30, 31, and the other or further weight members 30, 31 may then easily and quickly and readily and detachably attached or mounted or secured or anchored or retained or engaged onto the weight members 30, 31 that are attached to the end members 12, 13 of the handle 10 with the carrying member 70 and the latch members 33 of the weight members 30, 31. The handle 10 and the weight members 30, 31 may be arranged or formed and/or act as a dumbbell, a barbell or the like, and the weight members 30, 31 may be attached to only one of the end members 12, 13 of the handle 10 and to act as a kettlebell or the like. No supporting bases are required to be provided for supporting the weight plates or weight members in place when coupling the weight plates or weight members together.

Accordingly, the adjustable exercise device or dumbbell in accordance with the present invention includes an improved structure for allowing the weight members to be easily and quickly and readily and adjustably attached to or disengaged from the weight carrier or handle and for allowing the adjustable dumbbell to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable exercise device comprising:

a handle including a first end member and a second end member, a first carrier attached to said first end member of said handle, and including a first latch groove formed therein and located around a center portion of said first carrier, and including a cavity formed therein, said first latch groove of said first carrier including a first end portion and a second end portion, a first weight member including a first latch member extended therefrom for engaging with said first latch groove of said first carrier and for detachably attaching said first weight member to said first end member of said handle with said first carrier, said first weight member being rotatable relative to said first carrier and said first end member of said handle for causing said first latch member to move from said first end portion to said second end portion of said first latch groove of said first carrier and for detachably and selectively latching said first weight member to said first end member of said handle with said first carrier, and a lock member slidably attached to said first weight member and including a tongue extendible out of said first weight member for selectively engaging with said cavity of said first carrier and for selectively locking said first weight member to said first end member of said handle when said first latch member of said first weight member is moved to and engaged with said second end portion of said first latch groove of said first carrier.

2. The adjustable exercise device as claimed in claim 1, wherein said first weight member includes a spring biasing member engaged with said lock member for biasing and forcing said tongue of said lock member to engage with said cavity of said first carrier.

3. The adjustable exercise device as claimed in claim 1, wherein said first weight member includes a knob attached to said lock member for moving said lock member relative to said first weight member.

4. The adjustable exercise device as claimed in claim 3, wherein said first weight member includes a compartment formed therein for slidably receiving said lock member, and includes a channel formed therein and communicative with said compartment of said first weight member for slidably receiving said knob of said lock member.

5. The adjustable exercise device as claimed in claim 1, wherein said first end portion of said first latch groove of said first carrier is a relatively wider end portion, and said second end portion of said first latch groove of said first carrier is a relatively narrower end portion.

6. The adjustable exercise device as claimed in claim 5, wherein said first carrier includes a catch extended into said second end portion of said first latch groove of said first carrier for forming said relatively narrower end portion of said first latch groove of said first carrier.

7. The adjustable exercise device as claimed in claim 1, wherein said handle includes a recess formed in said first end member of said handle and defined by an outer peripheral fence for receiving and engaging with said first carrier.

8. The adjustable exercise device as claimed in claim 1, wherein said first latch member of said first weight member includes a stem extended outwardly from said first weight member, and an enlarged head provided on said stem and having an outer diameter greater than that of said stem.

9. The adjustable exercise device as claimed in claim 1, wherein said first weight member includes a carrying member attached thereto, and said carrying member includes a latch groove formed therein and located around a center portion of said carrying member, and said latch groove of said carrying member includes a first end portion and a second end portion.

10. The adjustable exercise device as claimed in claim 9, wherein said carrying member includes an aperture formed therein.

11. The adjustable exercise device as claimed in claim 9, wherein said first weight member includes a non-circular depression formed therein, and said carrying member includes a non-circular cross section for engaging with the non-circular depression of said first weight member and for preventing the carrying member from being rotated relative to said first weight member.

12. The adjustable exercise device as claimed in claim 9, wherein said first weight member includes two apertures formed therein and located around said center portion of said carrying member.

13. The adjustable exercise device as claimed in claim 9, wherein said carrying member includes a catch extended into said second end portion of said latch groove of said carrying member for forming a relatively narrower second end portion of said latch groove of said carrying member, and a relatively wider first end portion of said latch groove of said carrying member.

14. The adjustable exercise device as claimed in claim 1, wherein said first carrier includes at least one second latch groove formed therein and located around said center portion of said first carrier, and having a relatively wider first end portion and a relatively narrower second end portion.

15. The adjustable exercise device as claimed in claim 14, wherein said first weight member includes at least one second latch member extended therefrom for engaging with said at least one second latch groove of said first carrier.

16. The adjustable exercise device as claimed in claim 1 further comprising a second carrier attached to said second end member of said handle, and including a second latch groove formed therein and located around a center portion of said second carrier, and including a cavity formed therein, said second latch groove of said second carrier including a first end portion and a second end portion, a second weight member including a second latch member extended therefrom for engaging with said second latch groove of said second carrier and for detachably attaching said second weight member to said second end member of said handle with said second carrier, said second weight member being rotatable relative to said second carrier and said second end member of said handle for causing said second latch member to move from said first end portion to said second end portion of said second latch groove of said second carrier and for detachably latching said second weight member to said second end member of said handle with said second carrier, and a lock member slidably attached to said second weight member and including a tongue extendible out of said second weight member for selectively engaging with said cavity of said second carrier and for selectively locking said second weight member to said second end member of said handle when said second latch member of said second weight member is moved to and engaged with said second end portion of said second latch groove of said second carrier.

17. The adjustable exercise device as claimed in claim 16, wherein said second carrier includes a catch extended into said second end portion of said second latch groove of said second carrier for forming a relatively narrower second end portion and a relatively wider first end portion for said second latch groove of said second carrier.

18. The adjustable exercise device as claimed in claim 16, wherein said second latch member of said second weight member includes a stem extended outwardly from said second weight member, and an enlarged head provided on said stem and having an outer diameter greater than that of said stem.

19. The adjustable exercise device as claimed in claim 16, wherein said second weight member includes a carrying member attached thereto, and said carrying member includes a latch groove formed therein and located around a center portion of said carrying member, and said latch groove of said carrying member includes a first end portion and a second end portion.

* * * * *